United States Patent [19]

Siemers

[11] Patent Number: 4,782,884

[45] Date of Patent: Nov. 8, 1988

[54] METHOD FOR CONTINUOUS FABRICATION OF FIBER REINFORCED TITANIUM-BASED COMPOSITES

[75] Inventor: Paul A. Siemers, Clifton Park, N.Y.

[73] Assignee: General Electric Company, Schenectady, N.Y.

[21] Appl. No.: 10,654

[22] Filed: Feb. 4, 1987

[51] Int. Cl.[4] ..... B22D 23/00

[52] U.S. Cl. ..... 164/46; 164/461; 164/463

[58] Field of Search ..... 164/46, 131, 461, 463; 427/34

[56] References Cited

U.S. PATENT DOCUMENTS

| | | | |
|---|---|---|---|
| 3,427,185 | 2/1969 | Cheatham et al. | 427/34 |
| 3,606,667 | 9/1971 | Kreider | 427/34 X |
| 4,141,802 | 2/1979 | Duparque et al. | 427/34 X |
| 4,574,451 | 3/1986 | Smashey et al. | 164/46 X |
| 4,576,828 | 3/1986 | Walker, Jr. | 427/34 |

FOREIGN PATENT DOCUMENTS

| | | | |
|---|---|---|---|
| 57-74115 | 5/1982 | Japan | 164/46 |
| 60-184652 | 9/1985 | Japan | 427/34 |

*Primary Examiner*—Nicholas P. Godici
*Assistant Examiner*—J. Reed Batten, Jr.
*Attorney, Agent, or Firm*—Paul E. Rochford; James C. Davis, Jr.; James Magee, Jr.

[57] ABSTRACT

A number of individual silicon carbide filaments are assembled to form a tape. The tape is passed across a drum in a low pressure plasma deposition apparatus where the surface of the drum is formed of a polished and cooled refractory metal. The tape is sprayed with a plasma spray of the titanium base alloy metal to form a sheet of such metal on the tape and on the surface of the drum. The deposited sheet including the silicon carbide reinforcement tape is removed from the drum surface by peeling. The peeled product is a composite of titanium base sheet metal which is impregnated with the filaments of silicon carbide, i.e. a metal impregnated tape.

9 Claims, 4 Drawing Sheets

METHOD FOR CONTINUOUS FABRICATION OF FIBER REINFORCED TITANIUM-BASED COMPOSITES

RELATED APPLICATIONS

The subject matter of the subject application relates generally to that of copending application Ser. No. 010,655 filed Feb 4, 1987. It also relates to copending application Ser. No. 010,882, filed Feb. 4, 1987. The texts of the copending applications including those of related applications of the copending applications are incorporated herein by reference.

BACKGROUND OF THE INVENTION

The present invention relates to the formation of filament or fiber reinforced titanium-based composite materials. More particularly it relates to the process of formation on a continuous basis of titanium base alloy matrix composites containing silicon carbide filaments or fibers or similar high temperature high strength filaments as a reinforcing material.

Such materials have been identified as potential materials of high specific strength, that is high strength to weight materials, making them attractive for use in future aircraft engines having a high trust to weight ratios.

It is anticipated that $Ti_3Al$ and other titanium base alloy matrix composites will find application in wound rotors, casings and other intermediate temperature high stress applications. At present titanium base alloy matrix composites have been fabricated by rolling titanium base ingot to 0.010 inch thick sheet and then laying up alternate layers of titanium base alloy sheet with SiC fibers to form a laminate. The laminate is then consolidated by hot pressing or HIPing. The present process is believed to be inadequate for achieving high rates of production in industrial manufacturing. It is also believed to be too expensive for use in high rate production of such laminates.

As used herein the term titanium base alloy means an alloy composition in which titanium is at least half of the composition in parts by weight when the various alloy constituents are specified in parts by weight as, for example, in percentage by weight.

A titanium-aluminum intermetallic compound is a titanium base alloy composition in which titanium and aluminum are present in a simple numerical atomic ratio and the titanium and aluminum are distributed in the composition in a crystal form which corresponds approximately to the simple numerical ratio such as 3:1 for $Ti_3Al$, 1:1 for TiAl; and 1:3 for $TiAl_3$.

$Ti_3Al$ compositions have use temperatures of up to about 1400° F. as compared to the use temperatures of titanium alloys such as Ti-6Al-4V of up to about 1000° F. The use temperatures of TiAl is in the 1700°-1800° F. range.

A copending application Ser. No. 010,882 referenced above describes a method for overcoming many of the difficulties associated with a laminate sheet approach for fabricating titanium base alloy composites. The text of the copending application is incorporated herein by reference. The method described in copending application Ser. No. 010,882 employs a cylindrical drum and provides a closely spaced winding of silicon carbide fibers on the drum. The wound drum is then coated with a layer of titanium base alloy employing a rapid solidification low pressure plasma deposition process and particularly a process employing radio frequency energy for the plasma deposition process. The process forms a metal impregnated silicon carbide filament tape which serves as one of several layers for fabrication of a metal matrix composite layup. The layup is then consolidated by hot pressing or HIPing.

The method of copending application Ser. No. 010,882 offers a cost and performance benefit relative to the prior art preformed laminate sheet approach. However, the method of plasma forming the integral individual sheets of the copending application is not a continuous method of fabricating fiber containing metal impregnated sheet and for this reason is inferior to the subject process.

Novel and unique structures are formed by novel methods pursuant to the present invention by plasma spray deposit of titanium base alloys and titanium-aluminum intermetallic compounds employing RF plasma spray apparatus on a continuous basis.

The formation of plasma spray deposits of titanium and of alloys and intermetallic compounds of titanium present a set of processing problems which are unlike those of most other high temperature high strength materials such as the superalloys. A superalloy such as a nickel base, cobalt base, or iron base superalloy can be subdivided to relatively small size particles of −400 mesh (about 37 μm) or smaller without causing the powder to accumulate a significant surface deposit of oxygen. A nickel base superalloy in powder form having particle size of less than −400 mesh will typically have from about 200 to about 400 parts per million of oxygen. A powdered titanium alloy having the same particle size will by contrast typically have a ten fold higher concentration of oxygen. A powdered titanium alloy of −400 mesh will have between about 2000 and 4000 ppm of oxygen.

Moreover titanium alloy powder of less than −400 mesh size is recognized as being potentially pyrophoric and as requiring special handling to avoid pyrophoric behavior.

It is also recognized that the ductility of titanium alloys decreases as the concentration of oxygen and of nitrogen which they contain increases. It is accordingly important to keep the oxygen and nitrogen content of titanium base alloys at a minimum.

Prior art plasma spray technology is based primarily on use of direct current plasma guns. It has been recognized that most plasma spray deposits of the superalloys such as nickel and iron base superalloys have had relatively low ductility and that such deposits when in their as-deposited form can be cracked when bent through a sufficiently acute angle due to the low ductility.

I have discovered that RF plasma apparatus is capable of spraying powder of much larger particle size than the conventional d.c. plasma apparatus. I have discovered that particle sizes at least three times larger in diameter than those conventionally employed in d.c. plasma spray apparatus may be successfully employed in plasma spray practices and that the particle size may be as high as 100 μm to 250 μm and larger and as large as 10X as large as the −400 mesh powder previously employed in d.c. plasma spray practice.

This possibility of employing the larger powder particles is quite important for metal powders such as titanium which are subject to reaction and absorption of gases such as nitrogen and oxygen on their surfaces. One reason is that the surface area of particles relative to their mass decreases inversely as their diameters. Accordingly a three fold increase in particle diameter translates into a three fold decrease in particle surface area. I have discovered that one result is that RF plasma spray deposited structures of titanium base alloys made with the aid of larger particles have lower oxygen content than might be expected based on knowledge of prior art practices.

BRIEF STATEMENT OF THE INVENTION

It is accordingly one object of the present invention to provide a method for formation of silicon carbide reinforced titanium base alloy structures at relatively low cost.

Another object of the invention is to provide a method for formation of titanium aluminide sheet reinforced by silicon carbide fibers on a continuous basis.

Another object is to provide a method for forming titanium base alloy in thin sheet form and having silicon fiber reinforcement embedded therein.

Another object is to provide the sheet as described in the previous object on a continuous basis.

Other objects will be in part apparent and in part pointed out in the description which follows.

In one of its broader aspects objects of the invention can be achieved by providing a source of multiple strands of silicon carbide filaments, providing means to continuously align and closely space the filaments onto a cooled polished refractory metal drum to form a continuously advancing tape, rotating the drum to pass the tape of aligned and closely spaced filaments on the drum into a low pressure plasma deposition zone, providing a source of titanium base metal in powder form of relatively large particle sizes, supplying the titanium base powder to a low pressure RF plasma deposition gun so as to pass the powder through the gun and into a plasma flame of said gun, aiming the plasma flame from said gun at a portion of said drum in said low pressure plasma deposition zone to continuously deposit said titanium base metal powder in molten form on and among the filaments of the tape of aligned and closely spaced filaments to at least partially envelop fibers of said tape in the titanium base metal, continuously separating the titanium bearing tape from said drum after it has passed through said plasma deposition zone, and recovering the fiber bearing titanium base metal tape.

BRIEF DESCRIPTION OF THE DRAWINGS

The invention as described in the following specification will be understood with greater clarity if reference is made to the accompanying drawings in which.

DETAILED DESCRIPTION OF THE PRESENT INVENTION

Figure 1:
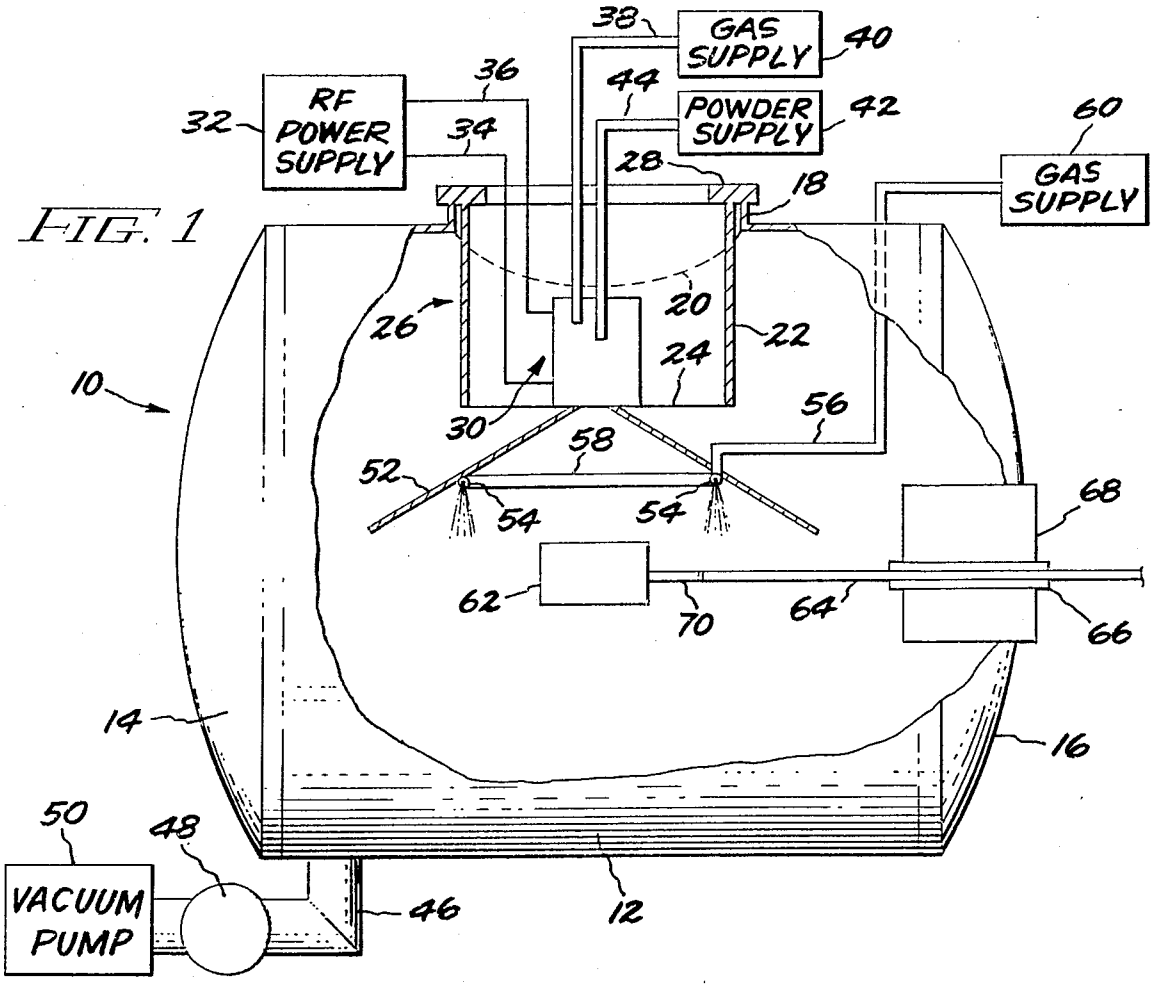
FIG. 1 is a schematic rendering of a radio frequency powered low pressure plasma deposition apparatus including a gun mounted within a low pressure chamber and having the plasma flame play on the surface of a rotating drum.

A low pressure radio frequency plasma spray deposit apparatus 10 is made up of a tank 12 having two removable end caps 14 and 16 and the associated apparatus as illustrated in FIG. 1. The tank may have a length of about 5 feet and a diameter of about 5 feet.

At the top of the tank 12 provision is made for introduction of an RF plasma gun into the top of the tank through an opening formed by cutting an opening in the tank wall and welding a collar 18 to the top of tank 12 along seam 20. The RF gun introduced into the tank is positioned within a container in the form of an inverted hat. The hat has sidewalls 22 and bottom wall 24 and has a rim 28 which seats on the collar 18 to provide a hermetic seal by techniques well known in the art.

The gun itself 30 is described in greater detail with reference to FIG. 2. The gun is mounted to the bottom wall 24 of the inverted hat container 26 and is supplied by power; by gas and by powder entrained in a carrier gas.

An RF power supply 32 delivers power to the gun 30 over lines 34 and 36. Greater details of its operation are given below with reference to FIG. 2.

Gas is supplied to the interior of gun 30 from gas source 40 through gas supply 38. Gas supply means 38 is representative of the means for supply of hydrogen gas or helium gas or argon gas or any mixture of gases as may be needed by the conventionally available RF plasma gun such as TAFA Model 66 used in connection with the examples below. The specific gases employed depend on the material being plasma sprayed. The specific gases to be used are known in the art. Also, powder entrained in a carrier gas, is supplied to the plasma gun from a powder supply means 42 through piping 44.

A low pressure of 200 to 400 torr is maintained within the tank 12 by means of a pump 50 operating through valve 48 and line 46 connected to the tank 12.

A problem of arc striking against wall interiors from the plasma was studied and was overcome by incorporation of a conical metal shield 52 extending down from gun 30 and by use of gas jets 54 disposed around the plasma flame from gun 30. Gas is supplied to the jets through the pipe 56 from exterior gas supply means 60. The jets are formed by gas flowing through openings drilled through an annular pipe mounted beneath conical shield 52. The pipe 58 serves as a manifold for the gas as well as providing the bottom drilled openings from which the gas jets 54 emerge.

The object illustrated as that to be coated by plasma spray deposit is a drum 62 held by attached bolt 70 at the end of an arm 64 extending through one end cap 16 of the tank 12. The arm 64 is hermetically sealed through the end cap 16 by a bushing 66 which is mounted within the box 68. Conventional means are provided in the box 68 for vertical positioning of the bushing 66 before the apparatus is evacuated. The rod may be raised or lowered to permit the position of drum 62 or other sample attached at the end of rod 64 to be adjusted to appropriate positions for the coating process to be performed prior to evacuation of tank 12.

While the plasma spray deposition is in progress, sliding lateral positioning of the drum by inward and outward movement of rod 64 through bushing 66 is also feasible. The drum is subject to rotation by imparting a rotary motion to the external portion of rod 64 by conventional means.

Figure 2:
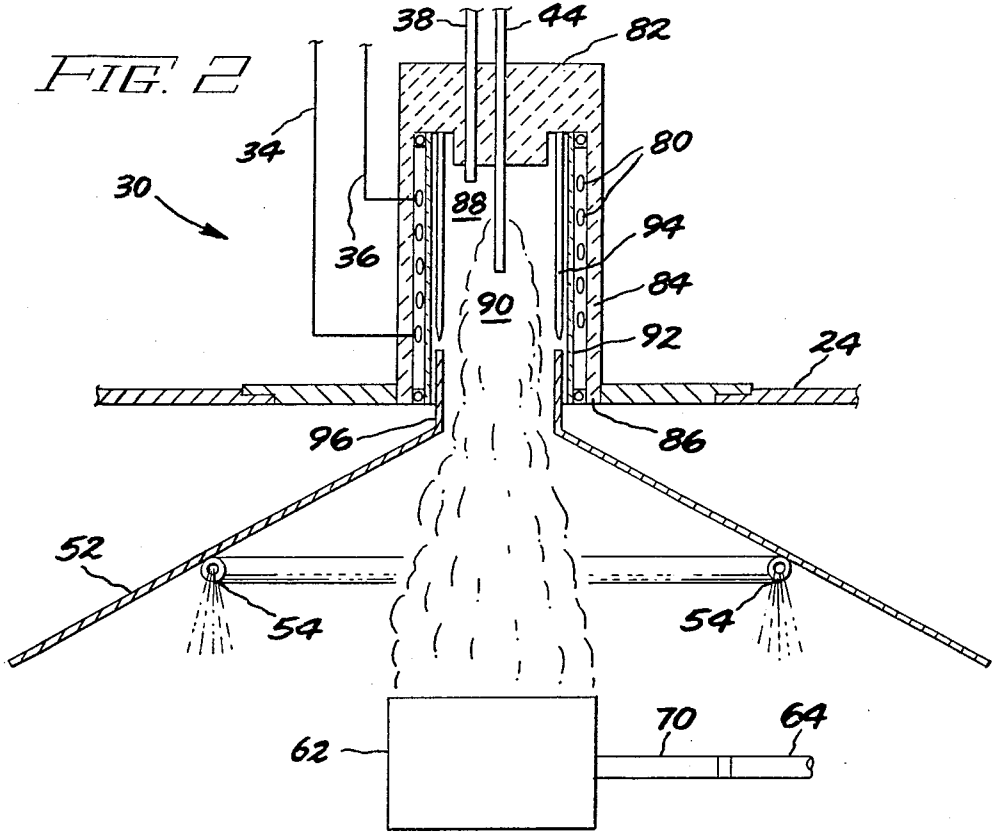
FIG. 2 is a schematic rendering of some details of the low pressure plasma deposition apparatus.

Turning now to FIG. 2, a more detailed description of the plasma gun and its operation is provided.

The elements shown in both FIGS. 1 and 2 which bear the same reference numerals are the same articles. It is evident from FIG. 2 that the gun 30 has RF electric supply means 34 and 36 which are the same as those illustrated in FIG. 1. These means are known in the art to be hollow tubes which carry the RF energy and which also carry water to and from the gun for water cooling. Water cooling is necessary because of the high temperatures of 10,000° to 12,000° K. generated within the gun.

Also, the gas supply pipe 38 and powder supply pipe 44 are provided in supply relationship to the elements of gun 30 as they were in FIG. 1.

The gun 30 is provided with a housing, which includes a closed top wall 82, side walls 84 and lower opening 86 from which the plasma flame extends.

Powder supply means 44 is a triple wall tube having a hollow innermost center tube for supply of powder and carrier gas. The triple wall is made up of a set of three concentric tubes having a cooling liquid, such as water, flowing in cooling relation in the inner and outer passages between the concentric tubes of powder supply means 44.

The gas is injected by means 38 into the top of the chamber 88 within gun 30 and above the zone in chamber 88 where the plasma is formed. The plasma itself is generated by having the radio frequency power impressed on the gas within the chamber 88. A suitable frequency range is from 2 to 5 megahertz. The lower end of this range is preferred.

The RF power is delivered through the lines 34 and 36 to a helical coil built concentric to the sidewalls 84 of the gun 30. Individual strands 80 of the coil are evident in section in FIG. 2. The RF coil, made up of strands 80, is separated from the chamber 88 and plasma 90 by a quartz tube 92 mounted as a liner within the gun 30. A water cooled copper liner 94 made up of a ring of water cooled fingers is also provided in gun 30 within quartz tube 92 as it has been found to assist the operation of the gun at higher powers. The space between gun walls 84 and quartz tube 92 is flooded with flowing cooling water (the strands 80 of the coil are in water) so that one side of the quartz tube 92 is directly water cooled.

An exit baffle 96 assists in orienting the flame of the plasma gun 30. The plasma 90 is formed within gun 30 and extends from the bottom of the gun downward into heat delivery relation to the target 63 mounted at the end of rod 64 by a bolt 70.

As explained above, I have found that a combination of the stainless steel shield 52 and the gas jets 54 have been successful in preventing an arcing or striking back from the plasma to the walls of the container of the low pressure plasma deposition apparatus 10 as illustrated in FIG. 1.

In operation, a gas or combination of gases is passed through supply means 38 into chamber 88 and the pressure of this gas is kept at a low value by the action of vacuum pump 50 operating through valve 48 and pipe 46 on the low pressure plasma deposition apparatus including tank 12. A pressure of about 250 torr is suitable. The tank itself has a length of about five feet and also a diameter of about five feet. Radio frequency power is impressed on the strands 80 of the coil to excite the gas passing into the housing through means 38. A plasma 90 is generated within the housing of gun 30. The plasma extends out from the housing and heats the surface of rotatable drum 62. The temperature of the plasma is about 10,000° to 12,000° K.

Powdered particles, entrained in a carrier gas, are introduced into the plasma 90 through tube 44. The heat of the plasma 90 is sufficiently high to cause a fusion of the particles as they move through the plasma and are then deposited as liquid droplets on the surface of the drum 62. I have found that the plasma from the RF gun as described above will fuse particles of relatively large diameter of more than 100 μm and will cause them to deposit on a receiving surface from essentially a liquid state.

The vacuum system is operated to maintain a pressure of approximately 250 torr in the low pressure plasma deposition chamber within the container 12. The drum 62 may be rotated within the evacuated chamber as the plasma is used to melt particles into molten droplets to be deposited on the surfaces thereof.

The powder feed mechanism 42 is a conventional commercially available device. One particular model used in the practice of this invention was a powder feeder manufactured by Plasmadyne, Inc. of California. It is equipped with a canister on top that holds the powder. A wheel at the bottom of the canister rotates to feed powder into a powder feed hose 44. The powder is then carried by the carrier gas from the powder feeder along the hose 44 to the chamber 88 of gun 30.

Conventionally, where a deposit is made with a low pressure plasma technique using a plasma gun such as 10 onto a relatively large surface such as drum 62 the surface itself is preferably heated prior to the deposit. The heating may be by means of the heat from the plasma gun itself before any powder is introduced into the gun.

However, I have found that it is advantageous to minimize or to eliminate such plasma preheating of a substrate before plasma spray deposition of titanium base alloy where the strong adhesion of the plasma deposited alloy is not desired. In fact, I deem it advisable to cool the substrate in order to reduce or eliminate such adhesion of the plasma deposited titanium base alloys. Accordingly, pursuant to one aspect of the subject invention a plasma spray deposit of titanium base alloy is made on a water cooled refractory metal rotating drum surface and is continuously removed from the drum as the drum rotates away from the plasma flame which delivers the deposit to the drum.

A typical run might be carried out under the following conditions:

| | |
|---|---|
| A power input of 60 Kilowatts | |
| A tank pressure of 250 torr | |
| Glass flow rates for a TAFA Model 66: | |
| Radial, argon | 117 liters/min. |
| Swirl, hydrogen | 5 liters/min. |
| Swirl, argon | 16 liters/min. |
| cold jet argon | 106 liters/min. |
| Particle Injection: | |
| Carrier, argon | 5 liters/min. |
| Powder Ti base alloy | 210–250 μm |
| Injection point above nozzle | 7.45 cm. |
| Deposition Data: | |

-continued

| | |
|---|---|
| Target Material | Preformed Steel Foil |
| Target size | |
| Distance Target Nozzle | 11.5" |
| Preheating Time | 10 min. |
| Deposition Time | 10 min. |
| Deposition Rate | 30 grams/min. |
| Mass Deposition efficiency | 90-95% |

EXAMPLE 1

Powder of titanium base alloy, Ti-6Al-4V, was obtained. The powder had been prepared by the plasma rotating electrode powder (PREP) process known in the art. The powder was screened to yield a powder product having a particle size range of 105 to 177 microns. This corresponds to a mesh of −80 to +140.

A rotary drum such as 62 of FIGS. 1 and 2 was prepared for plasma spray deposit. The first step was the mounting of a molybdenum foil onto the drum. The foil had a thickness of 0.002 inches and was made of molybdenum metal.

The surface of the drum was then wound as a second step with a continuous silicon carbide filament. The silicon carbide filament was prepared as described in one or more of the Avco Corp. U.S. Pat. Nos. 4,068,037; 4,127,659; 4,481,257; 4,315,968; 4,340,636 and 4,415,609. The filaments used had an average diameter of about 0.0056 inches. The filament is identified as SCS-6 and it was wound to have a spacing of about 130 filaments per inch.

This type of filament has a 30 μm diameter carbon case on which silicon carbide is coated by chemical vapor deposition. The coating of SiC is 55 μm thick.

Figure 5:
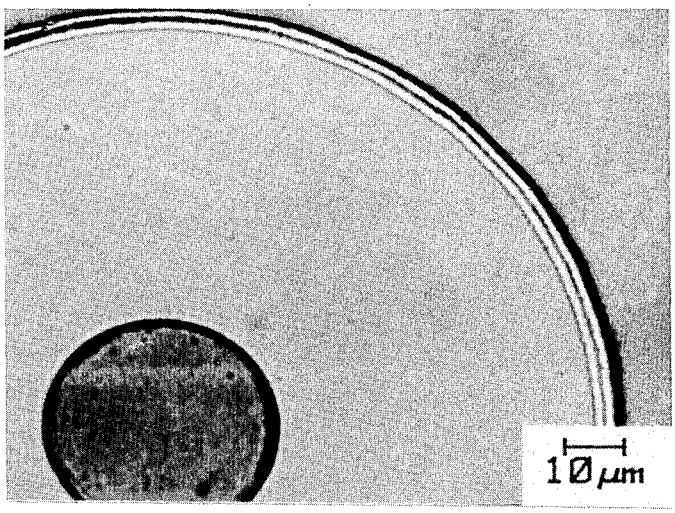
FIG. 5 is a photomicrograph of a magnified end view of a silicon carbide filament.

The outer surface of the SiC coating has two 1.0 to 1.5 μm thick pyrolytic carbon layers to give the filament an overall or total diameter of about 142 μm. A photomicrograph of a section through such a filament is shown in FIG. 5.

The carbon core serves as a substrate for the deposition of the SiC which is the structure part of the filament. The carbon surface layers are intended to minimize interaction between the SiC and the matrix material of the composite.

As part of their quality control the manufacturer has measured the tensile strength of the filament on the spool as 3150 MPa which is equivalent to 450 ksi. The strength of the filaments was thus somewhat below the values of 3450 to 4140 MPa generally credited to this type of filament.

The manufacturer, Avco Corp., have a value of the modulus of the SCS-6 filaments as being 400 GPa.

A steel bar strap was used to secure the SiC filaments to the drum and to prevent their unwinding from the drum surface as it was subjected to the plasma coating in the apparatus schematically described with regard to FIGS. 1 and 2. Molybdenum foil was employed as the substrate on the drum as it was deemed less reactive with titanium and accordingly it was employed to avoid interactions between the hot Ti-6Al-4V alloy and the exposed metal surface of the drum.

The silicon carbide filament wound drum was mounted as by the stem 70 and the motion of the drum was controlled by a substrate motion device external to the RF plasma spray facility as explained above. The drum was rotated at about 60 revolutions per minute and translated, that is given an axial motion, of about 1 inch per second while being subjected to the plasma spray deposit of the titanium-6 aluminum-4 vanadium powder, i.e. a titanium base alloy containing 6 weight percent aluminum and 4 weight percent vanadium and the balance titanium.

The substrate drum and foil and closely aligned silicon carbide filaments were not given any preheat prior to the spray deposit of the Ti-6Al-4V alloy powder on the surface thereof through the plasma gun. The duration of the spraying was about 3 minutes. Following the 3 minute plasma spray the drum was allowed to cool and was removed from the tank and apparatus. The steel strap securing the filaments to the drum surface was removed and the uncoated filaments covered by the strap were cut with an abrasive cutoff wheel.

Figure 4:
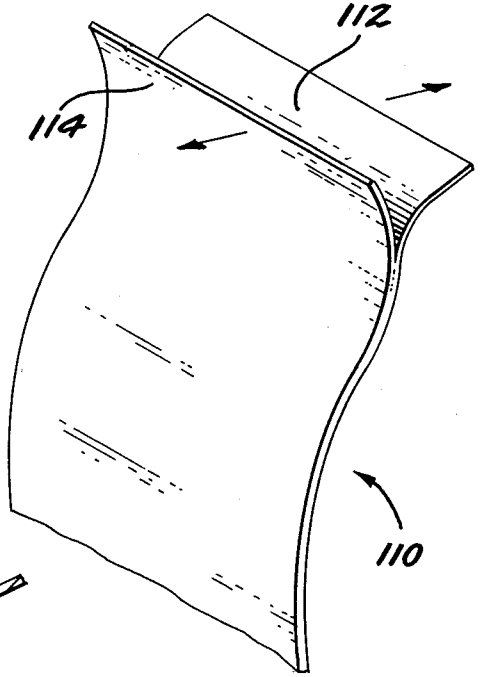
FIG. 4 is a detailed view of a composite foil formed of a titanium alloy on a preformed foil which may be of molybdenum, for example, and showing the two foils being separated from one edge by peeling.

Surprisingly it was noted that the Ti-6Al-4V alloy penetrated through the layer of filaments and contacted the substrate foil in the liquid state. However, the composite of Ti-6Al-4V alloy and impregnated silicon carbide filaments did not stick to the surface of the molybdenum foil. It was surprisingly simple to peel the silicon carbide filament laden titanium alloy sheet from the molybdenum foil and the peeling was accomplished essentially as illustrated in FIG. 4.

An inspection of the composite of titanium metal and reinforcing fibers revealed that the fibers were at least partially enveloped by the metal and that the metal had penetrated through the layer of fibers to make contact with the molybdenum foil.

EXAMPLE 2

The procedure of Example 1 was repeated but in this case the foil mounted to the drum was not a molybdenum foil but was rather one made of steel. It was found that the sprayed Ti-6Al-4V alloy adhered to the steel foil as a result of the plasma spray depositing. It was also observed that the alloy of titanium, aluminum and vanadium stuck to the surface of the steel foil where the spraying had been done either with a preheat or without a preheat of the surface on which the deposition was made. This experiment demonstrated that there is a surprisingly and startling difference between the adhesion of a deposit of plasma sprayed metal onto a steel surface as compared to the adhesion of plasma sprayed deposit of essentially the same titanium alloy onto a molybdenum surface.

Figure 3:
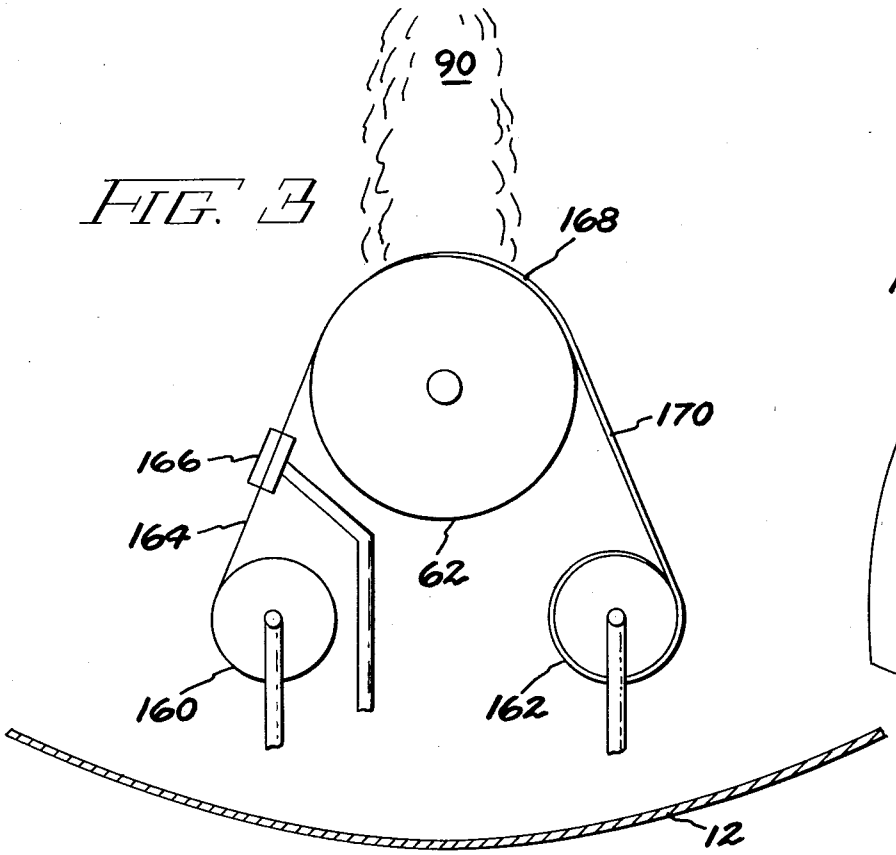
FIG. 3 is a semi-schematic rendering of a rotating drum as illustrated in FIG. 2 with an accompanying set of payout and takeup rollers for dispensing a silicon carbide fiber tape and taking up the tape after it has been infused with titanium base metal on the drum.

These examples demonstrated conclusively that it is feasible to form a composite material of titanium metal and fibers on a drum surface and to remove the formed composite from the surface by a simple peeling action. This capacity of molybdenum metal to receive a plasma deposit of a titanium alloy and to have the deposit separated from the molybdenum surface by peeling was a unique and unexpected discovery. To take advantage of this discovery an apparatus was designed as described here with reference to FIG. 3. In FIG. 3 a portion only of a low pressure plasma deposition tank 12 is shown. This portion of the tank corresponds roughly to the lower portion of tank 12 of FIG. 1. The tank and its contents are seen at right angles to the depiction in FIG. 1 so that a drum 62 is seen from the end whereas it is seen in side elevational view in FIG. 1 as drum 62. Plasma flame 90 may be seen emerging from the lower portion of gun 30 and it will also be seen to be playing on a surface of drum 62. Drum 62 has a surface which is formed of one of the refractory metals such as tungsten, tantalum, molybdenum or the like and preferably of molybdenum. Preferably the drum surface itself is polished and the drum is also internally cooled as by water cooling through conventional means not shown in FIG. 3.

Mounted for rotation with drum 62 in tank 12 are a payout spool 160 and a takeup spool 162. The payout spool 160 is provided with a web or tape 164 of aligned filaments such as silicon carbide filaments. Conventional means, now shown, are provided to permit web 164 to be paid out under tension from spool 160 and to be taken up under tension by the takeup spool 162.

The tape 164 advances from the payout reel 160 to an alignment and close spacing comb structure and device shown schematically as box 166. The tape 164 may be formed either as a preformed tape wound on payout 160 or can be formed by simultaneously feeding multiple spools, not shown, of continuous SiC filament into a comb-like device 166 of FIG. 3 to align and closely space the multiple filaments and to form a tape or web which advances onto the surface of drum 62.

As the drum itself is slowly rotated by action of rod 64 the tape of silicon carbide filaments moves across the drum 62. Also simultaneously a deposit of a titanium base alloy is made from the plasma flame 90 onto the surface of the drum and onto the tape of filaments which are moved across the portion of the face of the drum which is oriented upward toward the plasma flame 90.

The titanium base alloy metal deposits onto the tape of filaments 164 and in between the filaments onto the surface of the drum 62. In effect the plasma spray of the titanium base alloy onto the tape and drum surface causes the formation of a composite structure of titanium base alloy sheet which is impregnated with the SiC fibers. The sheet 168, however, is not adherent to the surface of drum 62 and lifts off as a free standing and independent sheet 170 as it leaves the drum surface and is wound onto the takeup spool 162.

Further pursuant to the present invention a continuous foil of unreinforced titanium base metal is formed by continuous deposit of metal from a plasma flame as described above onto a cooled drum surface of polished refractory metal and continuous peeling of the foil as a web from the drum surface. Such continuous fabrication of foil may be accomplished with the aid of the schematic apparatus of FIG. 3 by depositing the foil continuously on drum 62, continuously peeling the foil from drum 62 and continuously winding the foil onto takeup spool 162.

What is claimed is:

1. The method for fabrication of filament reinforced titanium base alloy in sheet form which comprises providing a source of multiple strands of silicon carbide filaments, providing means to continuously align and closely space the filaments onto a polished refractory metal drum to form a continuously advancing tape, rotating the drum to pass the tape of aligned and closely spaced filaments on the drum into a low pressure plasma deposition zone, providing a source of titanium base alloy metal in powder form having an average particle size in excess of 100 μm, supplying the powder to a low pressure radio frequency plasma deposition gun so as to pass through the plasma flame of said gun, aiming the plasma flame from said gun at a portion of said drum in said low pressure plasma deposition zone to continuously deposit said titanium base alloy metal powder in molten form on and among the filaments of the tape of aligned and closely spaced filaments and continuously separating the titanium base alloy bearing tape from said drum after it has passed from said plasma deposition zone.

2. The method of claim 1 in which the particle size of the powder is between 100 μm and 350 μm.

3. The method of claim 1 in which the alloy is Ti-6Al-4V.

4. The method of claim 1 in which the alloy is the intermetallic compound is $Ti_3Al$.

5. The method of claim 1 in which the alloy is a niobium modified $Ti_3Al$ in which niobium is substituted for titanium in the crystal lattice.

6. The method of claim 5 in which the empirical formula of the composition is Ti-14Al-21Nb.

7. The method of claim 1 in which the refractory metal is molybdenum.

8. The method of claim 1 in which the refractory metal surface is cooled during the plasma deposition of the titanium base alloy.

9. The method of continuously producing titanium base metal in foil form which comprises providing a source of titanium base metal in powder form, said powder having average particle diameter in excess of 100 μm, providing a radio frequency powered plasma spray gun, supplying said powder to said gun, plasma spray depositing said powder from said gun onto a rotating, cooled drum having a polished refractory metal surface to continuously form a self supporting foil thereon, and continuously peeling said self supporting foil from said drum to recover said foil.

* * * * *